US005239753A

United States Patent [19]

Kalis, Jr. et al.

[11] Patent Number: 5,239,753

[45] Date of Patent: Aug. 31, 1993

[54] PROCESS FOR FORMING CURVED VEHICLE BODY PANELS

[75] Inventors: George Kalis, Jr.; Thomas J. Boyer, both of Wooster, Ohio

[73] Assignee: Stahl/Scott Fetzer Company, Wooster, Ohio

[21] Appl. No.: 957,718

[22] Filed: Oct. 7, 1992

[51] Int. Cl.[5] ..... B23P 11/02; B21C 37/02

[52] U.S. Cl. ..... 29/897.2; 29/449; 72/379.2

[58] Field of Search ..... 29/446, 448, 449, 425, 29/421.1, 525.1, 897.2, 897.3, 897.32, 897.34, DIG. 3; 72/461, 379.2; 264/339; 425/DIG. 29

[56] References Cited

U.S. PATENT DOCUMENTS 1,937,663 12/1933 Norton ..... 72/379.2
3,057,119 10/1962 Kessier ..... 29/449
3,322,190 5/1967 Johnson, Jr. ..... 29/448
5,125,258 6/1992 Warner ..... 72/379.2

*Primary Examiner*—Joseph M. Gorski
*Assistant Examiner*—Khan V. Nguyen
*Attorney, Agent, or Firm*—Watts, Hoffmann, Fisher & Heinke

[57] ABSTRACT

A process and apparatus for forming curved vehicle door panels is disclosed. A jig is provided having a curved surface. A place of sheet metal is placed face down on the curved surface of the jig. The sheet metal is then compressed edgewise to cause it to bow in conformity with the curved surface. Then, a curved frame member is placed on the concave side of the bowed sheet metal. The frame is then fastened to the bowed sheets such that the frame holds the sheet in its bowed condition to form a curved vehicle door panel. Finally, the finished panel is removed from the jig.

5 Claims, 5 Drawing Sheets

PROCESS FOR FORMING CURVED VEHICLE BODY PANELS

BACKGROUND OF THE INVENTION

1. Field of the Invention

The present invention relates to vehicle body panels, and more particularly, to a process and apparatus for forming curved sheet metal truck door panels.

2. Description of Related Art

Utility truck bodies such as those used by tradesman are typically boxy and non-aerodynamic in appearance. The boxiness lends itself to simple manufacturing processes. A trend in truck body design is to provide aesthetically pleasing lines which call for some curved body panels. Curved body panels, however, add cost and complexity to the truck's construction.

Typically, curved vehicle door panels are formed by a metal-forming process using special dies. The dies are provided with a shaped surface for pressing the sheet metal into the desired shape. The dies are very expensive to produce and greatly increase the cost of the truck body. Thus, there is a need for an inexpensive method of producing curved vehicle door panels.

SUMMARY OF THE INVENTION

Basically, the process is one for forming curved vehicle body panels having a bowed sheet metal outer skin and ribs engaging the inner concave surface of the skin. First, a jig is provided having a curved support surface. Then, a piece of sheet metal is placed on the jig. The sheet metal is bowed to cause it to conform to the curved support surface. The jig maintains the sheet metal piece in a bowed condition. Next, a frame is provided having a plurality of curved ribs. The frame is positioned so that the ribs engage and conform to the concave side of the bowed sheet. Then, the frame is fastened to the bowed piece such that the frame maintains the sheet in its bowed condition to form a body panel. Last, the finished panel is removed from the jig.

In a preferred form of the process, prior to placing the sheet metal on the jig, tabs are formed at the outer edges of the sheet metal for later fastening the sheet metal to the frame. Also, the margins of the sheet are folded inward to form double-thick borders.

The jig basically includes a curved surface having a profile which corresponds to a predetermined curved vehicle panel shape, a stop located on one side of the curved surface and a pushes located on the opposite side of the curved surface. The pusher is adapted to compress a sheet metal blank edgewise against the stop to cause the blank to bow into conformity with the curved surface.

BRIEF DESCRIPTION OF THE DRAWINGS

A preferred embodiment of the invention is shown in the accompanying drawings in which.

DESCRIPTION OF THE PREFERRED EMBODIMENT

Figure 1:
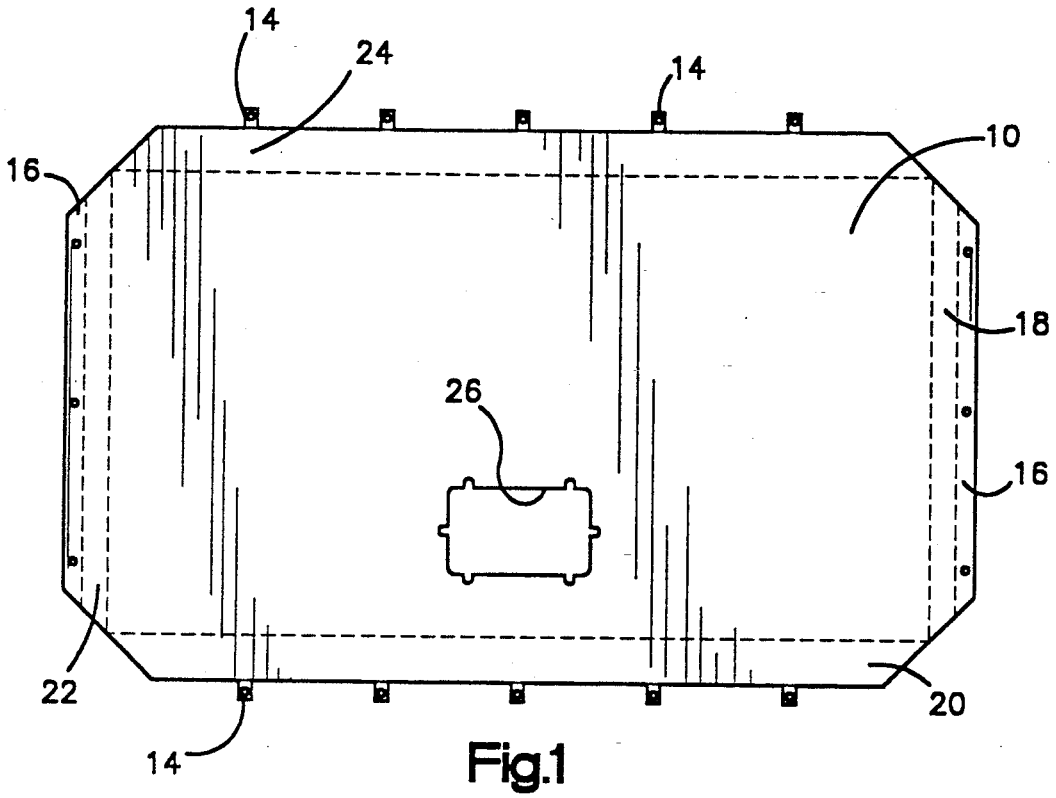
FIG. 1 is a top plan view of a sheet metal blank prepared for the process of the present invention.

Referring to FIG. 1, a planar sheet metal blank 10 formed in accordance with the present invention is shown. The blank 10 forms the outer skin 11 of a vehicle door panel 12. The blank 10 includes a plurality of small tabs 14 along the sides and a large tab 16 at each end. Broken lines indicate margins 18, 20, 22, 24. A hole 26 is formed in the blank 10 for receiving a door latch (not shown).

Figure 2:
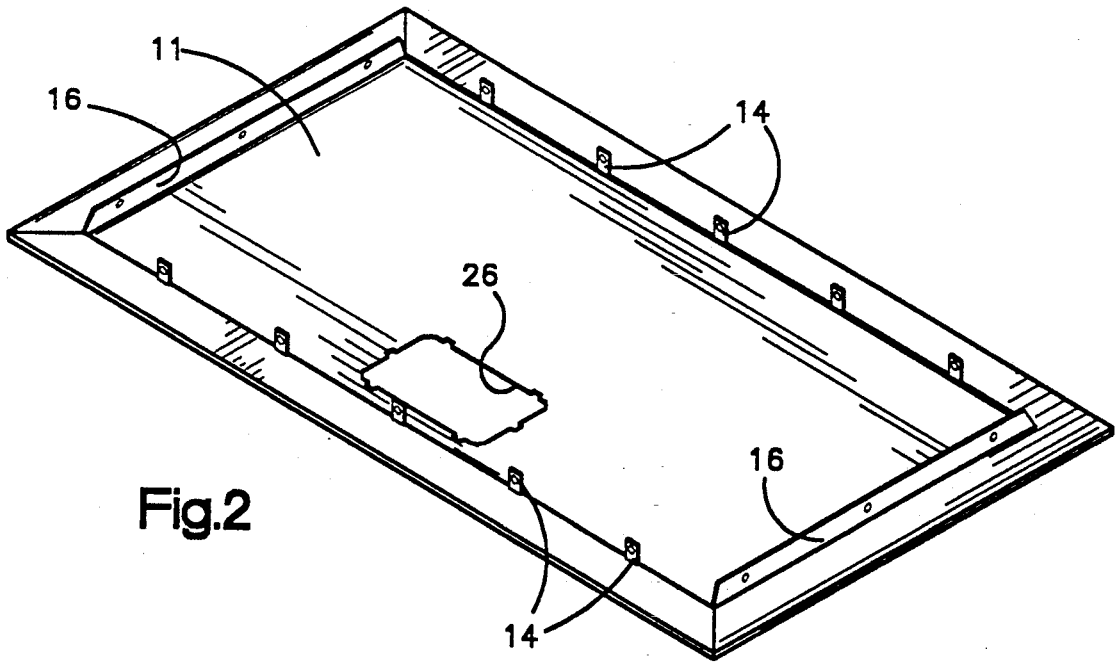
FIG. 2 is a perspective view of an outer skin member formed by the sheet metal blank of FIG. 1.

The tabs 14, 16 are bent to the position shown in FIG. 2 to form right angles to the margins 18, 20, 22, 24. Then, as seen in FIG. 2, the margins are bent approximately 180° to form double-thick borders along the edges of the blank 10. The tabs 14, 16 thus extend away from the back of the blank 10 at right angles to the blank 10 after the double-thick borders are formed.

Figure 3:
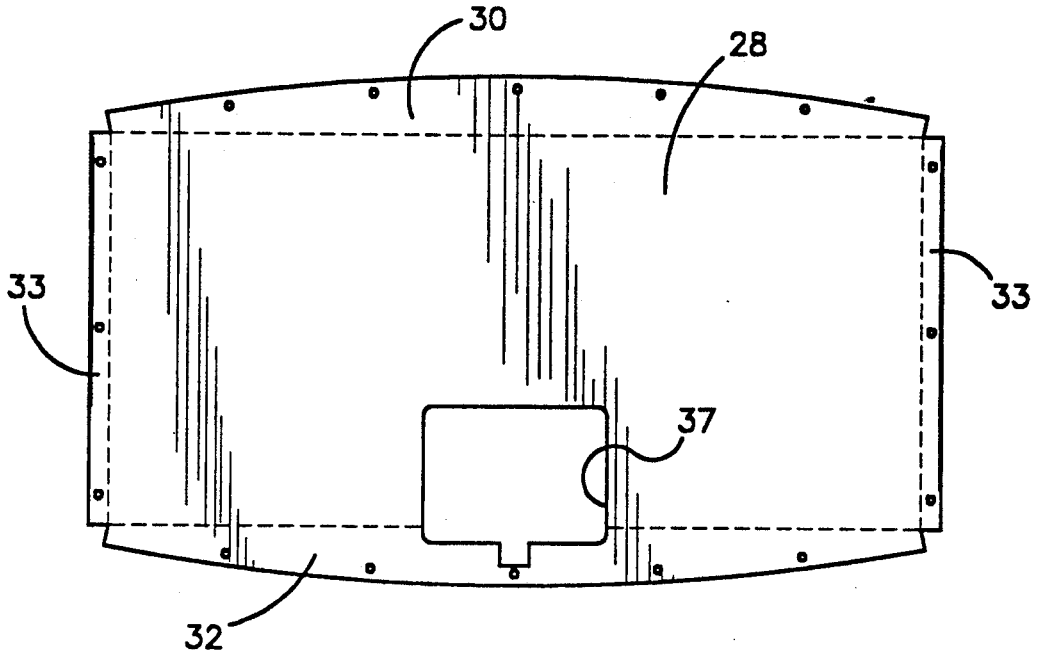
FIG. 3 is a top plan view of a prepared sheet metal blank used to form the frame of the present invention.
Figure 4:
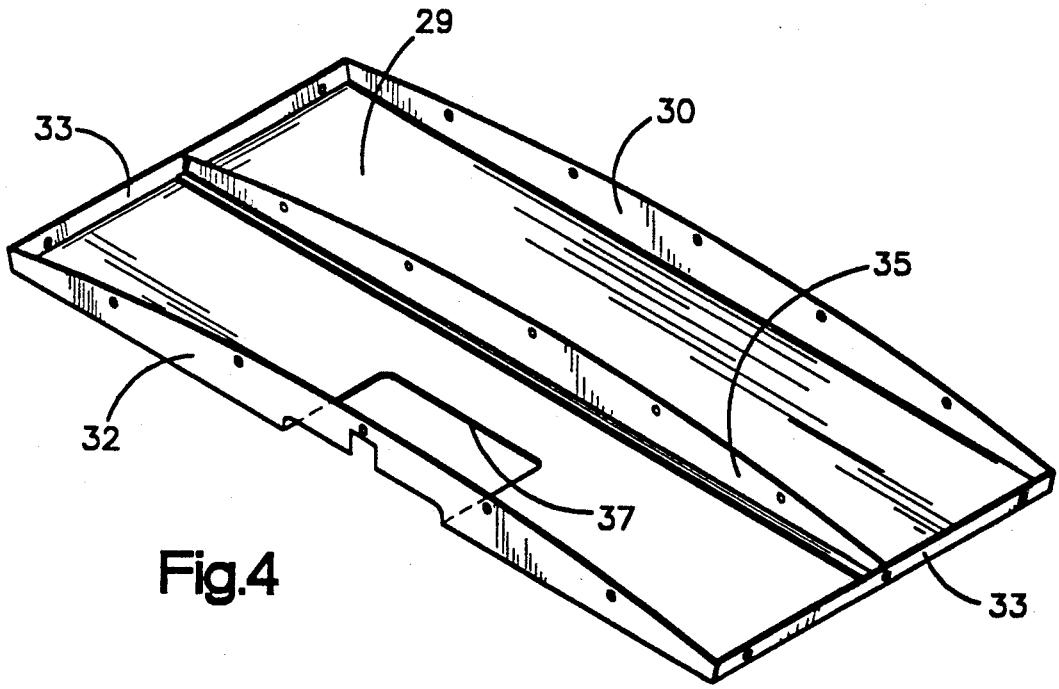
FIG. 4 is a perspective view of a frame member formed by the blank of FIG. 3.
Figure 5:
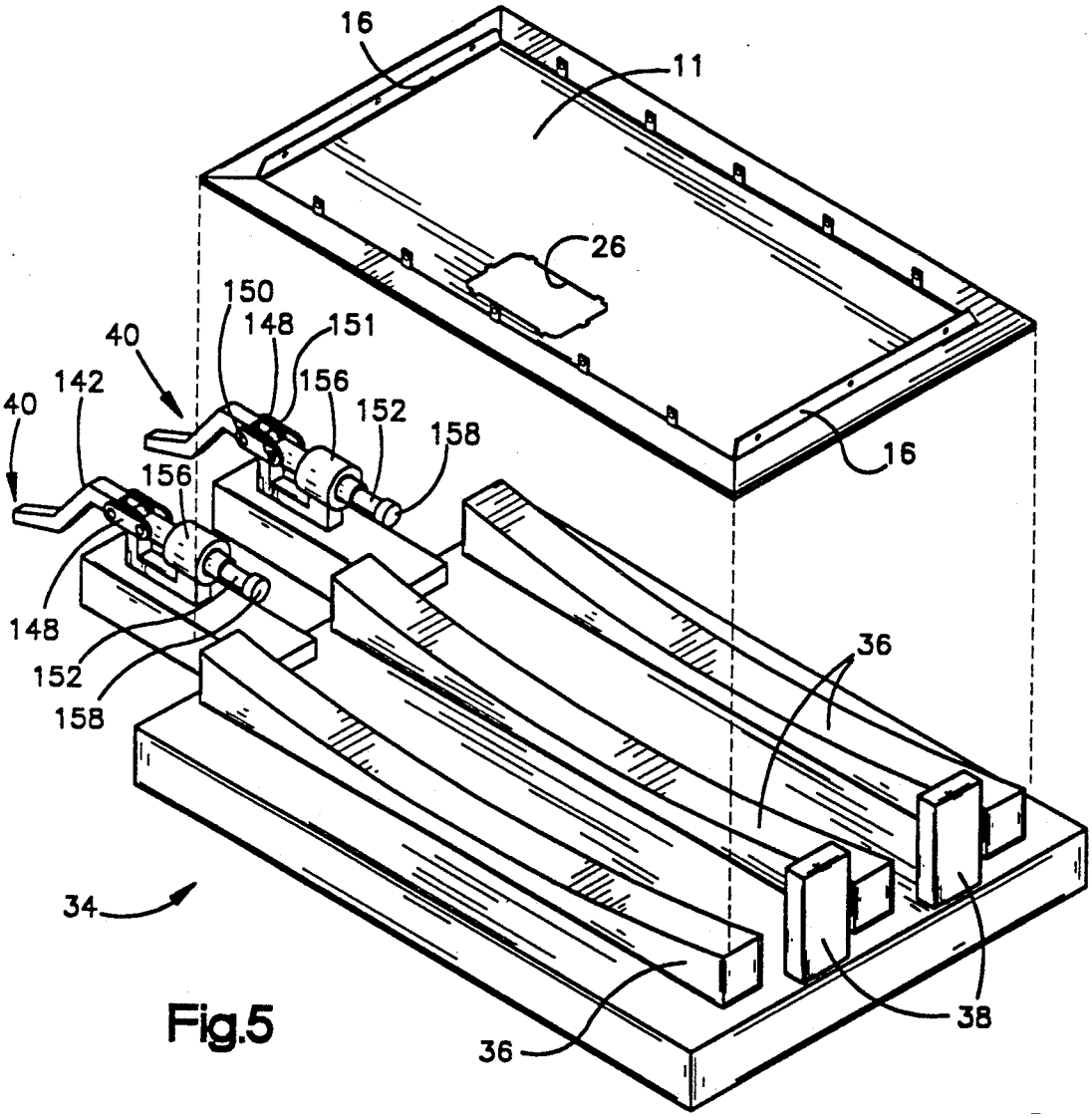
FIG. 5 is a perspective view of a jig in accordance with the present invention.
Figure 6:
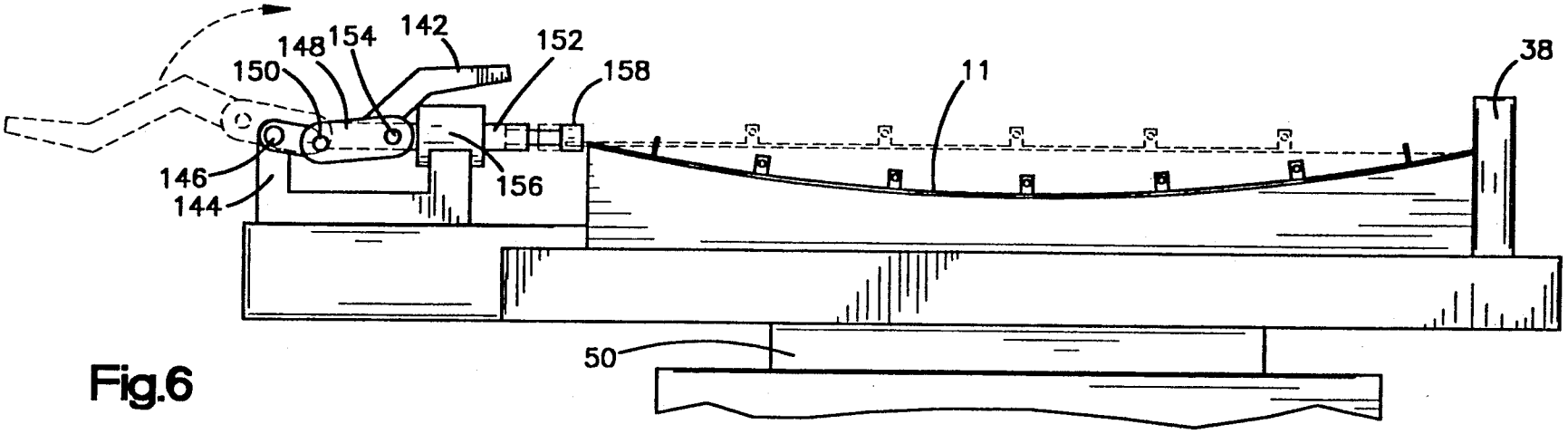
FIG. 6 is a side elevational view of the jig of FIG. 5 and the outer skin member of FIG. 2.
Figure 7:
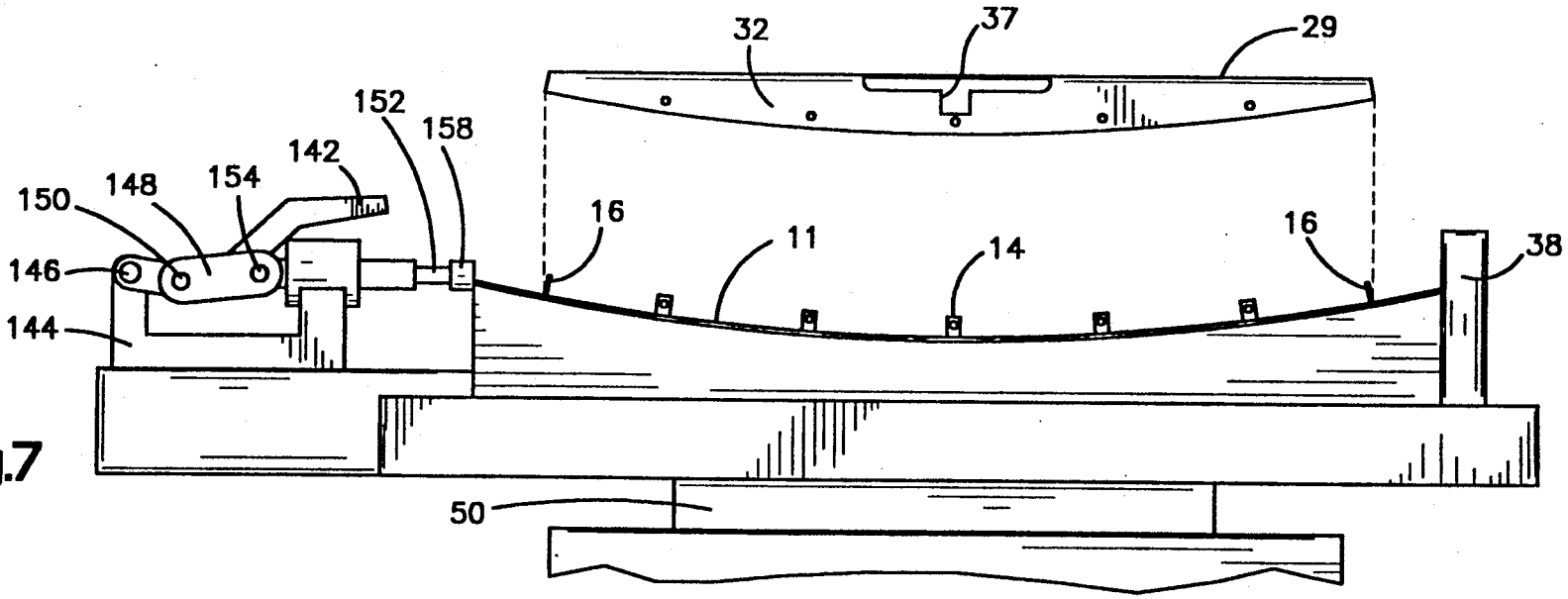
FIG. 7 is a side elevational view of the jig of FIG. 5 showing the assembly of a door panel.
Figure 8:
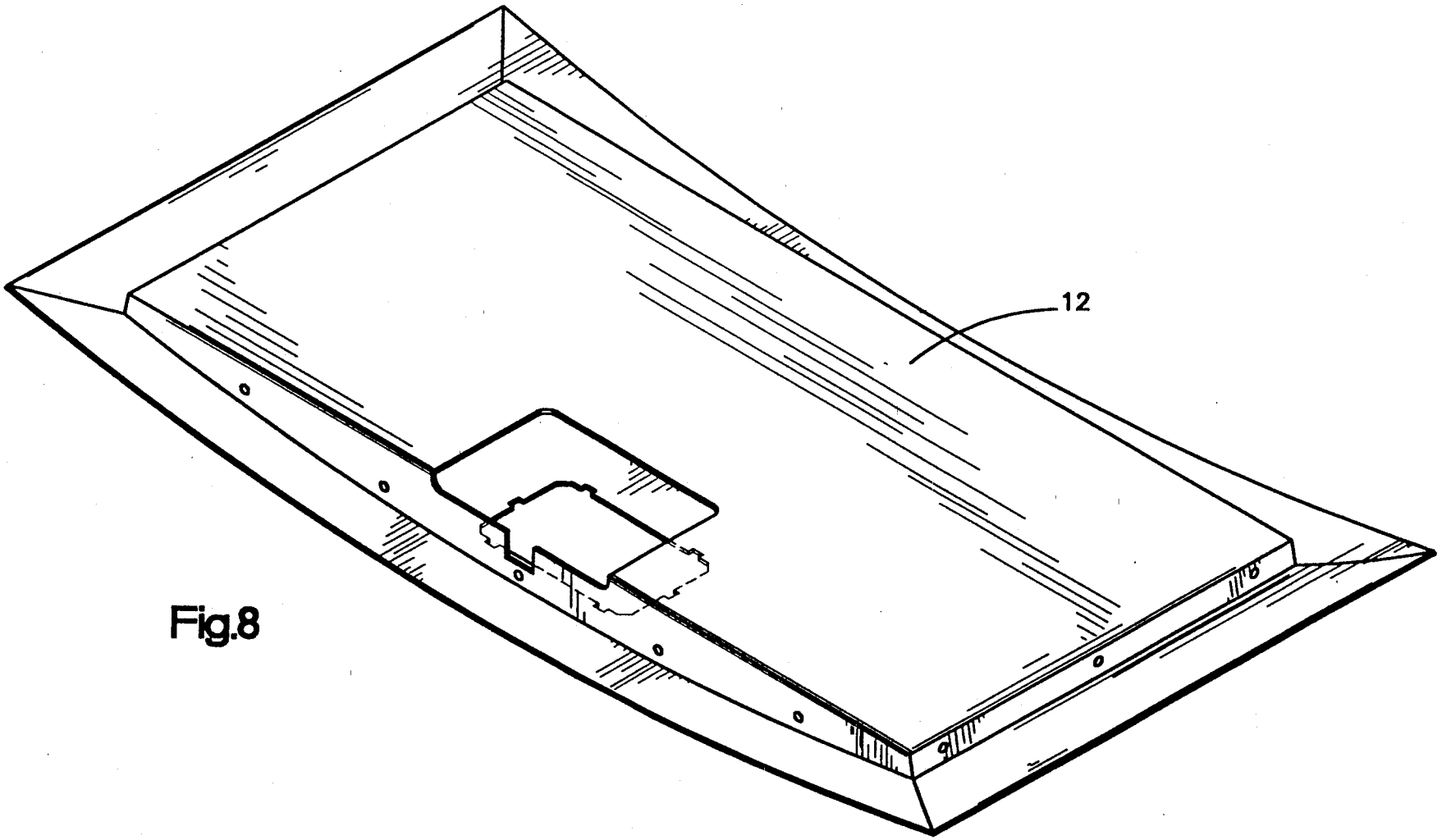
FIG. 8 is perspective view of a finished door panel.

Referring to FIG. 3, a blank 28 is shown for forming a frame member 29. The blank 28 includes a pair of curved ribs 30, 32 along its sides indicated by broken lines. The blank also includes a pair of tabs 33, one at each end. The ribs 30, 32 and the tabs 33 are folded approximately 90° to form the frame member 29 of FIG. 4. A third rib 35 is fastened between and parallel to the ribs 30, 32 to provide additional support. A hole 37 is formed in the blank 28 to accommodate the door latch.

The assembly of the frame member 29 and the outer skin member 11 to form a finished door panel 12 is done with the help of a jig 34. The jig 34 includes a plurality of curved supports 36, a pair of stops 38, and a pair of pushers 40. The curved supports 36 are given a shape which determines the curvature of the finished door panel 12.

Each pusher 40 includes a handle 142 which is pivotably mounted to a base 144 at a pivot joint 146. A pair of links 148 are pivotably mounted to the handle 142 at a pivot joint 150 and to a reciprocating rod 152 at a pivot joint 154. The rod 152 is slidably mounted to the base 144 at a bearing 156. A foot 158 is mounted to the distal end of each rod 152 for engaging the member 11. Movement of the handle 142 causes the rod 152 to slide longitudinally for engagement or disengagement with the member 11.

The outer skin member 11 is placed on the supports 36 between the stops 38 and the pushers 40 with the tabs 14, 16 extending upward. Then, the handles 44 are lifted to compress the outer skin member 11 between the stops 38 and the feet 42. This causes the outer skin member 11 to bow into conformity with the curve supports 36. The outside of the member 11 becomes convex and the inside becomes concave. The handles 44 are locked in their upper position when the outer skin member 11 is fully bowed. Once the pivot joint 150 moves below an imaginary line drawn between the pivot joints 150 and 154, the handle 142 will be locked in its upper position. That is, the reaction force on the rod 152 will hold the handle 142 upward until it is returned to its down position. Next, the curved rib surface of the frame member 29 is placed on the concave surface of the outer skin member 11. Holes formed in the tabs 14, 16 are aligned with corresponding holes formed in the tabs 33 and the ribs 30, 32. Rivets are then placed through the holes in both members to fasten them together. Finally, the handles 44 are lowered and the finished door panel 12 is removed from the jig 34.

In the preferred embodiment, the jig 34 is mounted on a bearing support 50 to allow the jig 34 to rotate freely in a horizontal plane. This allows a worker to have access to all of the rivet holes during assembly simply by rotating the jig 34.

While a preferred embodiment of this invention has been described in detail, it will be apparent that certain modifications or alterations can be made without departing from the spirit and scope of the invention set forth in the appended claims.

We claim:

1. A process for forming curved vehicle body panels having a bowed sheet metal skin and ribs engaging a concave surface of the skin comprising the steps of:

a) providing a jig having a curved surface;
b) placing a piece of sheet metal on said jig;
c) compressing said sheet metal edgewise thereby causing it to bow into conformity with said curved surface;
d) providing a frame having a plurality of ribs having curved edges;
e) positioning said frame on said bowed sheet such that said curved edges engage and conform to a concave side of said bowed sheet;
f) fastening said frame to said bowed sheet such that said frame holds said sheet in its bowed condition thereby forming a curved body panel; and
g) removing said panel from said jig.

2. A process for forming curved vehicle door panels having a bowed sheet metal skin and ribs engaging a concave surface of the skin comprising the steps of:

a) providing a sheet metal skin having a plurality of tabs extending from its edges;
b) providing a jig having a curved surface;
c) positioning said skin on said jig;
d) compressing said sheet metal skin edgewise thereby causing it to bow into conformity with said curved surface so that said tabs are located on a concave side of said skin;
e) providing a frame having a plurality of ribs having curved edges;
f) positioning said frame on said bowed sheet such that said curved edges engage and conform to the concave side of said bowed sheet metal skin;
g) fastening said frame to said tabs such that said frame holds said sheet metal skin in its bowed condition thereby forming a curved body panel; and
h) removing said panel from said jig.

3. A process for forming curved vehicle body panels having a bowed sheet metal skin and ribs engaging a concave surface of the skin comprising the steps of:

a) providing a jig having a curved surface;
b) placing a piece of sheet metal on said jig;
c) bowing said sheet metal to cause it to conform to said curved surface with holding means comprising a pusher member for engaging one edge of said sheet and a stop member for engaging the opposite edge whereby said sheet is compressed between said pusher member and said stop member to cause the sheet to bow;
d) maintaining said piece of sheet metal in a bowed condition;
e) providing a frame having a plurality of curved ribs;
f) positioning said frame so that said ribs engage and conform to a concave side of said bowed piece of sheet metal;
g) fastening said frame to said bowed piece of sheet metal such that said frame maintains said sheet in its bowed condition thereby forming a body panel; and
h) removing said panel from said jig.

4. A process for forming curved vehicle body panels having a bowed sheet metal skin and ribs engaging a concave surface of the skin comprising the steps of:

a) providing a jig having a curved surface;
b) forming tabs extending from outer edges of a piece of sheet metal;
c) bending said tabs such that they extend substantially normal to said piece of sheet metal;
d) folding the margins of said piece of sheet metal over to form double-thick borders;
e) placing said piece of sheet metal on said jig;
f) bowing said sheet metal thereby causing it to conform to said curved surface;
g) maintaining said sheet metal in a bowed condition;
h) providing a frame having a plurality of curved ribs;
i) positioning said frame so that said ribs engage and conform to a concave side of said bowed piece of sheet metal;
j) fastening said frame to said tabs such that said frame maintains said piece of sheet metal in its bowed condition thereby forming a body panel; and
k) removing said panel from said jig.

5. The process according to claim 4, and further comprising the step of forming holes in said tabs and corresponding holes in said frame and wherein step j) comprises riveting said frame to said tabs through said holes.

* * * * *